United States Patent [19]

Okamoto

[11] Patent Number: 4,619,234

[45] Date of Patent: Oct. 28, 1986

[54] ELECTRONICALLY CONTROLLED FUEL INJECTION APPARATUS

[75] Inventor: Kenji Okamoto, Higashimatsuyama, Japan

[73] Assignee: Diesel Kiki Co., Ltd., Japan

[21] Appl. No.: 751,079

[22] Filed: Jul. 2, 1985

[30] Foreign Application Priority Data

Jul. 3, 1984 [JP] Japan ..... 59-136584

[51] Int. Cl.[4] ..... F02D 41/38; F02M 59/20

[52] U.S. Cl. ..... 123/357; 123/486; 364/431.05

[58] Field of Search ..... 123/357, 486; 364/431.05

[56] References Cited

U.S. PATENT DOCUMENTS 4,368,705 1/1983 Stevenson et al. ..... 123/357
4,549,517 10/1985 Kamiyama ..... 123/486 X
4,566,068 1/1986 Iwasaki et al. ..... 123/357 X
4,566,417 1/1986 Suzuki et al. ..... 123/357 X

FOREIGN PATENT DOCUMENTS 12138 1/1984 Japan ..... 123/357

*Primary Examiner*—Tony M. Argenbright
*Attorney, Agent, or Firm*—Guy W. Shoup

[57] ABSTRACT

In an electronically controlled fuel injection apparatus having a fuel injection pump with a fuel regulating member, computing unit for calculating target data relating to a target amount of fuel injection in response to an engine condition signal, the computing unit comprises first circuit for performing two dimensional map calculation in response to the engine condition condition signal so as to obtain plural sets of data pairs of position data of the fuel regulating member and the corresponding engine speed data, and second circuit responsive to the speed data for carrying out an interpolation calculation on the basis of the plural sets of data pairs in order to obtain data relating to the target amount of fuel injection at the engine speed at each instant. The interpolation calculation can be accomplished merely by a two dimensional interpolation calculation so that the time required for calculating the target amount of fuel injection can be remarkably reduced.

7 Claims, 5 Drawing Figures

ELECTRONICALLY CONTROLLED FUEL INJECTION APPARATUS

BACKGROUND OF THE INVENTION

The present invention relates to an electronically controlled fuel injection apparatus, more particularly to an electronically controlled fuel injection apparatus for stably operating an internal combustion engine without deteriorating the response of the engine.

Electronically controlled fuel injection apparatus in which the fuel injection pump of an internal combustion engine is operatively controlled by use of a microcomputer are in wide use. The conventional electronically controlled fuel injection apparatus of this kind is constructed in such a manner that the deviation between a target or preset amount of fuel injection of the fuel injection pump, calculated in accordance with the operating conditions of the engine, and the actual amount of fuel injection is determined, and a fuel regulating member of the fuel injection pump is controlled in accordance with the result of the determination. An injection apparatus according to this arrangement is disclosed for instance in Japanese Patent Application Disclosure No. Sho 57-49032/82.

In the disclosed apparatus, in order to determine the target amount of fuel injection, a three dimensional map is used for determining the required amount of fuel injection on the basis of data indicative of the engine speed and the amount of operation of an accelerator pedal, and data indicative of the required (target) amount of fuel injection at each instant is calculated by a map calculation using the three dimensional map and an interpolation calculation which is based on the result of the map calculation and is carried out in the operation steps for calculating a basic fuel injection amount executed within a microcomputer.

In the injection apparatus of the kind described above, an improvement in the control response as well as in the stabilization of the engine speed is required. To this end, it is necessary to minimize the control time between the time point at which the engine speed data is obtained and the time point at which the fuel regulating member is positioned at the right position for the engine speed. A well-known system for realizing this involves calculating the target amount of fuel injection in synchronization with the occurrence of the pulses used as the basis for calculating the engine speed. For example, in one such widely used system an interrupt program for calculating the target amount of fuel injection in response to the input of the pulses is employed.

However, when the target amount of fuel injection is calculated on the basis of the three dimensional map by an interrupt program executed in response to the occurrence of the pulses, the interpolation calculation for the three dimensional map becomes so complex that most of the microcomputer's time has to be used for the interpolation calculation and this in turn greatly reduces the number of main program steps that can be executed and as a consequence remarkably lowers the response in other control operations.

SUMMARY OF THE INVENTION

It is an object of the present invention to provide an improved electronically controlled fuel injection apparatus.

It is another object of the present invention to provide an electronically controlled fuel injection apparatus which is capable of quickly carrying out a calculation of a target amount of fuel injection.

It is still another object of the present invention to provide an electronically controlled fuel injection apparatus in which the calculation of a target fuel injection amount can be rapidly carried out, stabilization of the engine speed can be realized with good response, and execution of a main control program can be carried out without hindrance even when the calculation of the target amount of fuel injection is executed by an interrupt processing synchronized with the engine speed.

According to the present invention, an electronically controlled fuel injection apparatus having a fuel injection pump for supplying fuel to an internal combustion engine, an actuator for controlling the operating position of a fuel regulating member for the fuel injection pump, means for producing a condition signal indicating the operating condition of the internal combustion engine, computing means for calculating target data relating to a target amount of fuel injection in response to the condition signal, and means for driving said actuator so as to obtain said target amount of fuel injection in response to the result of the calculation from said computing means, is characterized in that said computing means comprises first calculating means for performing two dimensional map calculation in response to the condition signal so as to obtain plural sets of data pairs, one member of each pair being indicative of the position of said fuel regulating member and the other member thereof being indicative of the corresponding engine speed, means for generating speed data relating to the speed of the internal combustion engine, and second calculating means responsive to the speed data for carrying out an interpolation calculation once every predetermined degree of rotation of said internal combustion engine, the interpolation calculation being carried out on the basis of the plural sets of data pairs obtained from said first calculating means in order to obtain data relating to the target amount of fuel injection at the engine speed at each instant.

With this construction, the interpolation calculation carried out in the second calculating means can be accomplished merely by a two dimensional interpolation calculation so that the time required for calculating the target amount of fuel injection can be remarkably reduced, as compared with the conventional three dimensional interpolation calculation.

Accordingly, even when the interpolation calculation is carried out for every pulse, the time for the calculation of the target amount of fuel injection in the second calculating means can be made small and the calculation for obtaining the target amount of fuel injection can be quickly performed. As a result, the target amount of fuel injection can be calculated every time a pulse is produced, so that stabilization of the engine speed can be realized and the control response can be improved. Furthermore, an increase in the number of operations becomes possible because of the reduction in the time required for calculating the target amount of fuel injection and the number of steps that can be executed in other control operations can be increased even when the calculation for the target fuel injection amount is executed by interruption of the microcomputer, thus improving the control response and stability of the engine rotation or engine speed as well.

The invention will be better understood and the other objects and advantages thereof will be more apparent from the following detailed description of preferred embodiments with reference to the accompanying drawings.

DESCRIPTION OF THE PREFERRED EMBODIMENTS

Figure 1:
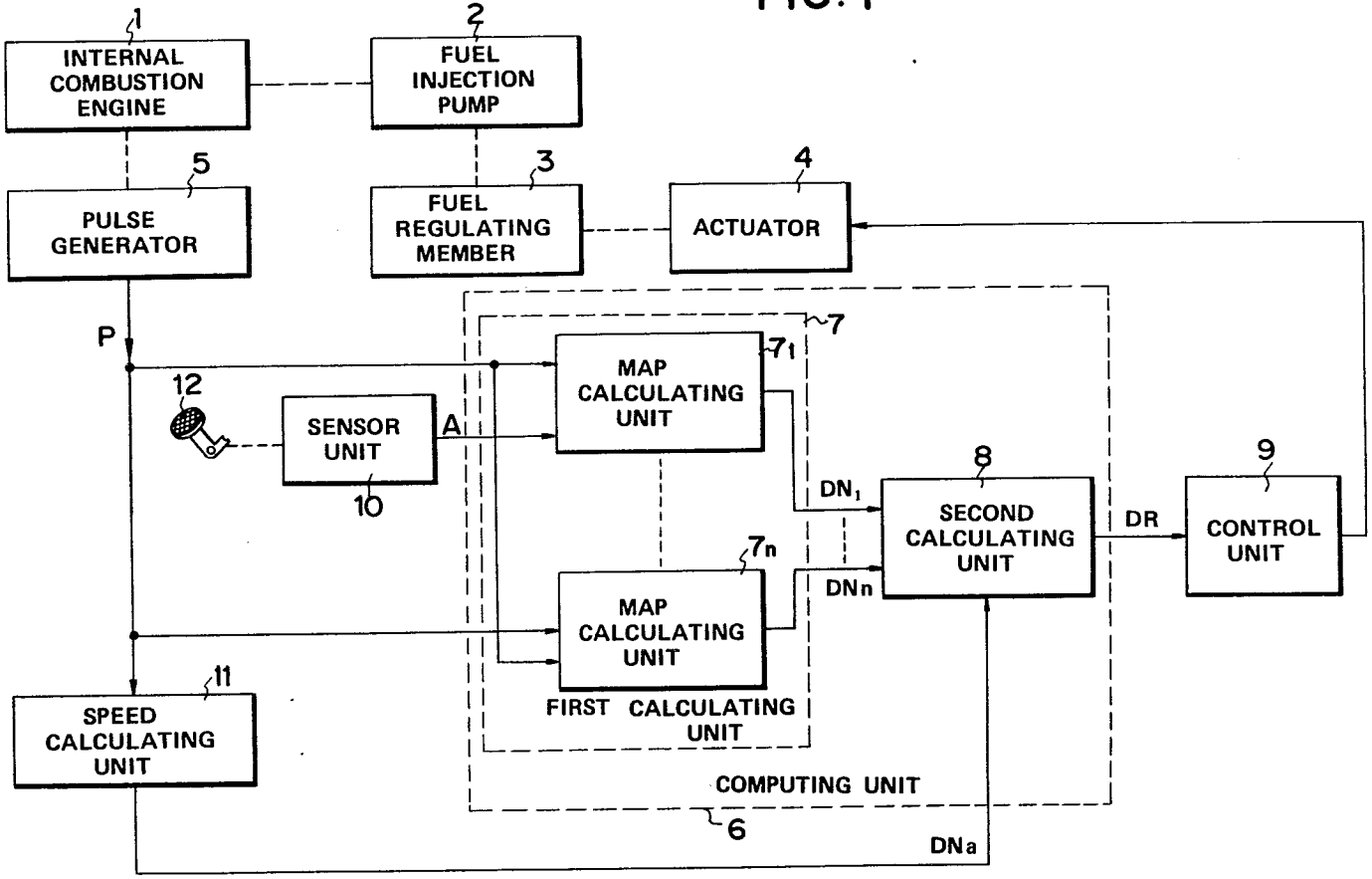
FIG. 1 is a block diagram of an electronically controlled fuel injection apparatus according to the present invention.

FIG. 1 shows a block diagram of an embodiment of an electronically controlled fuel injection apparatus according to the present invention. In FIG. 1, a fuel injection pump 2 for providing fuel to an internal combustion engine 1 has a fuel regulating member 3 for regulating the amount of fuel injection and the fuel regulating member 3 is operated by an actuator 4. Pulses P are produced from a pulse generator 5 at a period relating to the engine speed of the internal combustion engine 1 and are supplied as a synchronizing signal to a computing unit 6 for computing a target amount of fuel injection. The calculating operation for obtaining the target amount of fuel injection in the computing unit 6 is carried out in synchronization with the pulses P.

The computing unit 6 has a first calculating unit 7 for performing calculations in response to acceleration data A received from a sensor unit 10 and indicative of the amount of the operation of an accelerator pedal 12. The first calculating unit 7 has a plurality of map calculating units $7_1$ through $7_n$.

The map calculating units $7_1$ through $7_n$ contain respective two dimensional maps indicative of the relationship between the engine speed N and the amount of operation of the accelerator pedal 12 indicated by acceleration data A when the regulated position R of the fuel regulating member 3 is at $R_1$, $R_2$, . . . $R_n$, respectively.

At each of the positions $R_1$, $R_2$, . . . $R_n$, the corresponding engine speed $N_1$, $N_2$, . . . $N_n$ for any given value $A_1$ of acceleration data A is calculated in the corresponding map calculating unit $7_1$, $7_2$, . . . $7_n$ on the basis of the two dimensional map thereof.

Figure 2:
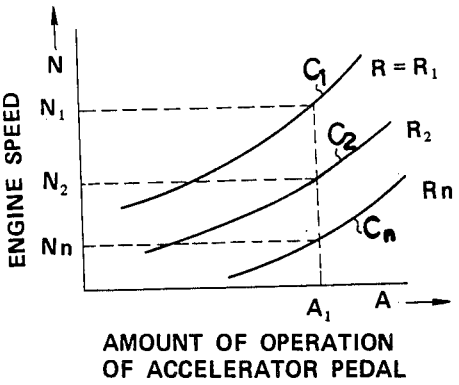
FIG. 2 is a graph showing characteristic curves corresponding to map data stored in map calculating units in the apparatus of FIG. 1.

FIG. 2 shows characteristic curves $C_1$ to $C_n$ corresponding to the map data stored in each of the map calculating units $7_1$ to $7_n$. As will be understood from the foregoing descriptions and FIG. 2, in the map calculating unit $7_1$, the map calculation is carried out for obtaining the engine speed $N_1$ corresponding to any given value $A_1$ of the acceleration data A for the case of $R=R_1$, and in general, in the map calculating unit $7_n$, the map calculation is carried out for obtaining the engine speed $N_n$ corresponding to the amount of operation of the accelerator pedal 12 for the case of $R=R_n$.

Data $DN_1$, $DN_2$, . . . $DN_n$ indicating the engine speed $N_1$, $N_2$, . . . $N_n$ obtained from the map calculating units $7_1$ to $7_n$ are applied to a second calculating unit 8 to which speed data $DN_a$ indicating the actual engine speed $N_a$ at each instant is also applied. The actual engine speed $N_a$ is calculated in a speed calculating unit 11 on the basis of the period of the pulses P, and the calculated result in the speed calculating unit 11 is output as speed data $DN_a$. In the second calculating unit 8, the target position $R_d$ of the fuel regulating member 3 for the actual engine speed $N_a$ at each instant is calculated by interpolation from the relationship between each regulated position $R_1$, $R_2$, . . . $R_n$ and the corresponding engine speed indicated by data $DN_1$ to $DN_n$.

Figure 3:
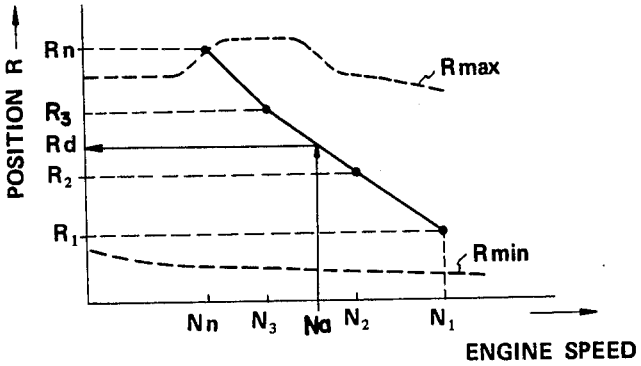
FIG. 3 is a graph for illustrating how an interpolation is carried out in the electronically controlled fuel injection apparatus according to this invention.

FIG. 3 illustrates how this interpolation calculation is carried out in the case where $A=A_1$. As will be seen from FIG. 3, $R_d$ in this case is defined by the following formula:

$$R_d = N_a \times \frac{R_3 - R_2}{N_3 - N_2} + \frac{R_2 \times N_3 - R_3 \times N_2}{N_3 - N_2}$$

Returning to FIG. 1, the data DR indicative of the target position $R_d$ of the fuel regulating member 3, which is calculated in the second calculating unit 8, is applied to a control unit 9 which drivingly controls the actuator 4 so that the fuel regulating member 3 assumes the position $R_d$.

With this construction, the interpolation calculation to be executed in the second calculating unit 8 can be accomplished by a mere two dimensional interpolation calculation so that the time required for calculating the target fuel injection amount can be remarkably reduced, as compared with the conventional three dimensional interpolation calculation.

Accordingly, even when the interpolation calculation is carried out for every pulse P, the time for the calculation of the target amount of fuel injection in the computing unit 6 can be made small. As a result, it becomes feasible to calculate the target amount of fuel injection every time a pulse P is produced, so that stabilization of the engine speed can be realized and control response can be improved, while an increase in the number of operations also becomes possible because of the reduction in the time required for calculating the target amount of fuel injection, whereby the number of steps executed in other control operations can be increased even when the calculation of the target amount of fuel injection is executed by interruption of the microcomputer. There is thus realized an improvement in the control response and the stability of the engine rotation or engine speed, as well.

Figure 4:
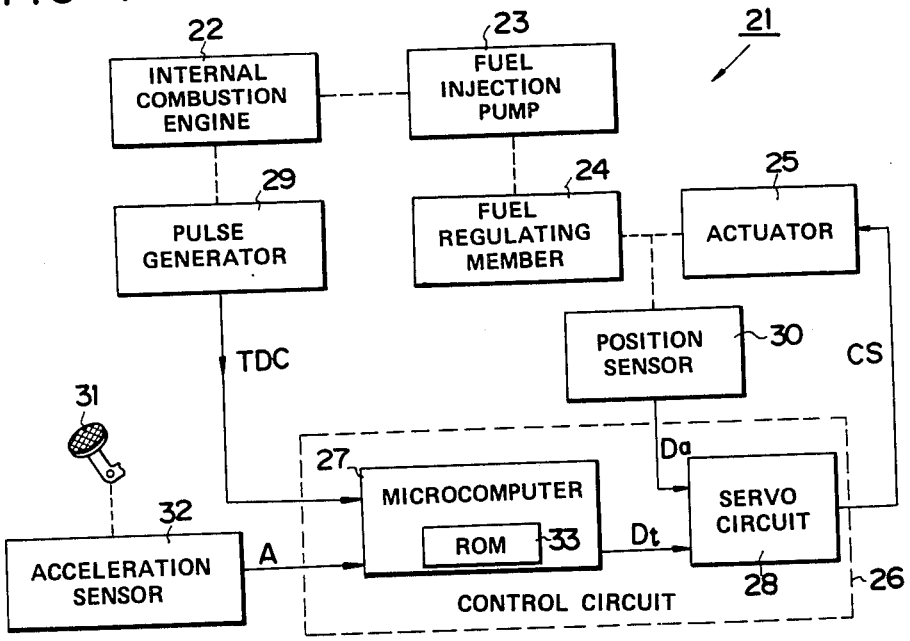
FIG. 4 is a block diagram of another embodiment of an electronically controlled fuel injection apparatus according to the present invention.

FIG. 4 shows a block diagram of another embodiment of the electronically controlled fuel injection apparatus according to the present invention. The electronically controlled fuel injection apparatus 21 comprises a fuel injection pump 23 for supplying fuel to an internal combustion engine 22 with a plurality of cylinders (not shown), and a fuel regulating member 24 for regulating the fuel to be injected from the fuel injection pump 23 is positioned by an actuator 25 operative in response to a control signal CS from a control circuit 26.

The control circuit 26 for supplying the control signal CS to the actuator 25 consists of a microcomputer 27 and a servo circuit 28 and to the microcomputer 17 there is applied accelerator data A which is produced by an acceleration sensor 32 for detecting the amount of the operation of an accelerator pedal 31 and indicates the amount of the operation of the accelerator pedal 31 at each instant and top dead center pulse TDC from a pulse generator 29 for generating pulses in response to the upper dead center timing of the pistons of the internal combustion engine 22. The microcomputer 27 calculates the position of the fuel regulating member 24 required for obtaining the target amount of fuel injection corresponding to the operating condition of the engine 22 at each instant, based on predetermined governor characteristics in response to the top dead center pulses TDC and the acceleration data A and it produces target position data $D_t$ indicating the result of the calculation. The target position data $D_t$ is applied to the servo circuit 28.

A position sensor 30 is operatively coupled to the fuel regulating member 24 for detecting the actual position of the fuel regulating member 24. The position sensor 30 produces actual position data $D_a$ which indicates the position of the fuel regulating member 24 at each time point and the data $D_a$ is applied to the servo circuit 28. The servo circuit 28 produces the control signal CS for driving the actuator 25 so as to match the actual position of the fuel regulating member 24 with the target position indicated by the data $D_t$. Thus the fuel regulating member 24 is moved to the required position by driving the actuator 25 in response to the control signal CS, thereby electronically controlling the fuel injection pump 23 to inject an amount of fuel corresponding to the operating condition of the engine 12 at each instant.

Figure 5:
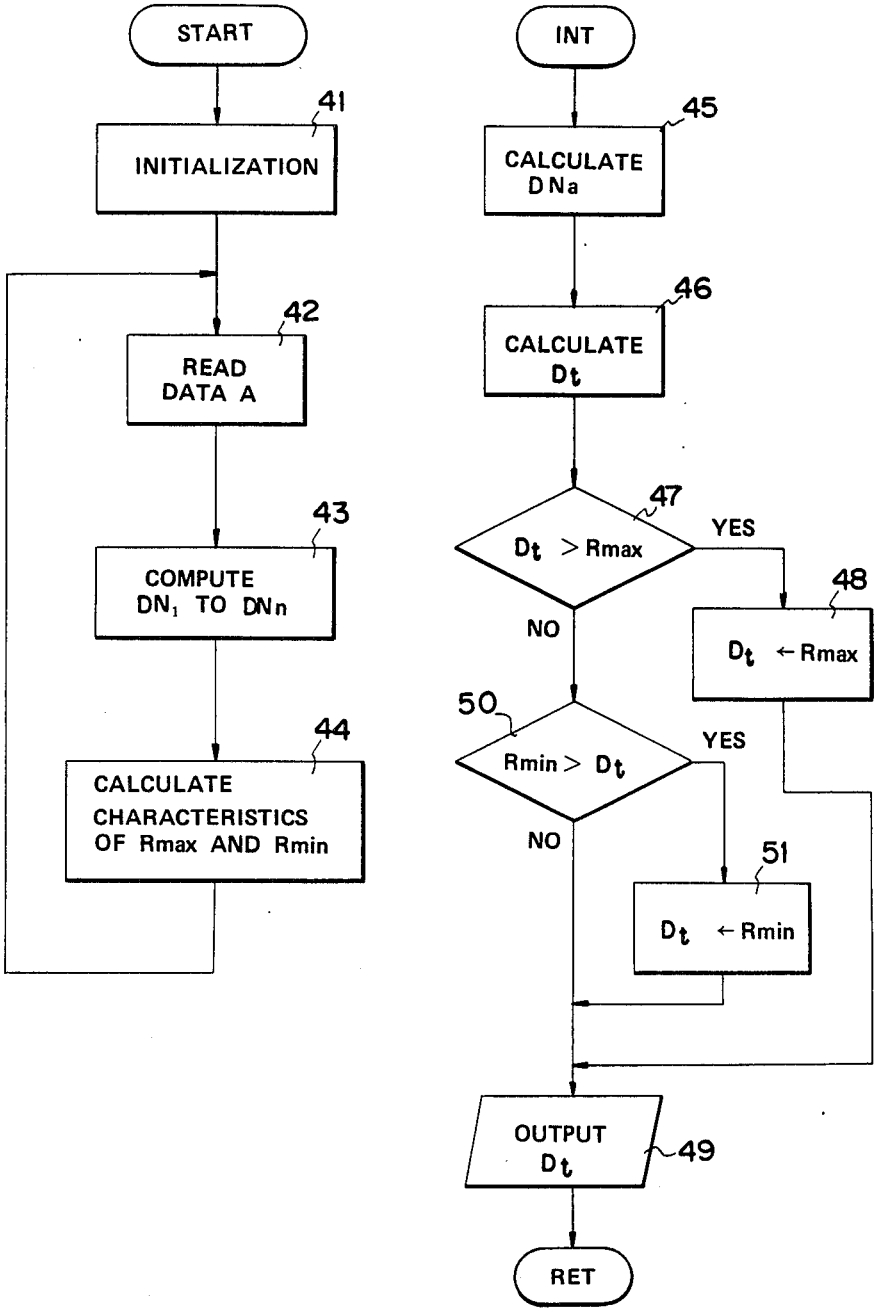
FIG. 5 is a flow chart representing a control program for calculating a target amount of fuel injection in the apparatus of FIG. 4.

FIG. 5 shows a flow chart of a control program for calculating the target amount of fuel injection. The control program is stored in a ROM 33 in the microcomputer 27 shown in FIG. 4 and executed in the microcomputer 27 in order to perform the calculation for obtaining the target amount of fuel injection, which is equivalent to the calculation performed in the computing unit 6.

In operation, after starting the control program, an initialization is performed in the step 41 and then the operation moves to the step 42, where the accelerator data A is read in the microcomputer 27 in FIG. 4. As described in the foregoing with reference to FIG. 1, a plurality of two dimensional maps, which indicate the relationship between the accelerator data A and the engine speed N where the position R of the fuel regulating member 24 is taken as a parameter, are stored in the ROM of the microcomputer 17. Thus, when the operation moves to the step 43, the data $DN_1$ to $DN_n$ indicating the engine speeds corresponding to the respective positions $R_1, R_2, \ldots R_n$ are calculated in the step 43 in response to the accelerator data A. This calculation is completely the same as that performed in the first calculating unit 7 described in the foregoing in connection with FIG. 2.

After the execution of the step 43, the operation moves to the step 44, where calculations for determining the characteristics of the maximum position $R_{max}$ of the fuel regulating member 24 corresponding to predetermined maximum characteristics of fuel injection and for determining the characteristics of the minimum position $R_{min}$ of the fuel regulating member 24 corresponding to predetermined minimum amount characteristics of fuel injection are carried out. The curves indicating the characteristics of the maximum and minimum positions $R_{max}$ and $R_{min}$ are shown by dotted lines in FIG. 3. When the calculation in the step 44 is completed, the opration moves to the step 42 and the steps 42 to 44 are repeatedly executed.

The control program includes an interrupt program INT as shown, which is executed in response to the occurrence of the top dead center pulse TDC. When the interrupt program INT is executed upon the application of the top dead center pulse TDC, data $DN_a$ indicating the engine speed at that time is first calculated from the period between top dead center pulses TDC in the step 45 and the operation moves to the step 46, where target position data $D_t$ indicating the optimum position of the fuel regulating member 24 at the engine speed at that time shown by data $DN_a$ is obtained by interpolation calculation from the relationship between the positions $R_1, R_2, \ldots R_n$ of the fuel regulating member 24 and the corresponding data $DN_1$ to $DN_n$, calculated in the main program. In the interpolation calculation, for example, the value $R_d$ of data $D_t$ in case of $N=N_a$ is carried out in accordance with the characteristic curve plotted between the data pairs $(N_1, R_1)$, $(N_2, R_2), \ldots$ as described in the foregoing in connection with FIG. 3.

When the target position data $D_t$ is obtained in the manner as described, a decision is made as to whether the value of data $D_t$ has fallen below the $R_{max}$ calculated in the step 44. Namely, in the step 47, a decision is made as to whether $D_t > R_{max}$. When the result of the decision is YES, i.e., $D_t > R_{max}$, the operation moves to the step 48, where the content of data $D_t$ is replaced with the value $R_{max}$ and the data $D_t$ showing the value $R_{max}$ is output as the target position data in the step 49.

However, if the result of the decision in the step 47 is NO, i.e., $D_t \leqq R_{max}$, the operation now moves to the step 50, where another decision is made as to whether $R_{min} > D_t$ is established. When the result of the decision in the step 50 is YES, that is, $R_{min} > D_t$, the operation moves to the step 51, where the content of data $D_t$ is replaced with the value $R_{min}$ and the data showing the value $R_{min}$ is output as the target position data $D_t$. On the other hand, however, if the result of the decision in the step 50 is NO, i.e., the data $D_t$ is between $R_{max}$ and $R_{min}$, the data calculated in the step 46 is output, as it is, as the target position data $D_t$.

In the manner described above, the two dimensional map calculation is carried out by the main program in response to the accelerator data A, while the interpolation calculation of the target position data $D_t$ is performed by the interrupt program INT in accordance with the engine speed at each instant so that the time required for the interpolation calculation can be shortened. Accordingly, the time for executing the interrupt program INT can be shortened and the other control operations and the like to be executed in the microcomputer 17 can be performed without hindrance.

According to the present invention, since the maps necessary for calculating the target fuel injection amount are two dimensional maps and the required interpolation calculation can be carried out using the result of the calculation based on the two dimensional maps, the interpolation calculation can be made by two dimensional calculations, with the result that the time required for calculating the target fuel injection amount can be remarkably reduced. As a result, even when the calculation of the target fuel injection amount is performed by interruption every time the reference rotational pulse is produced, the time required for performing the interrupt operation can be shortened, thus making available sufficient time for the other control operations and calculations and also enabling the calculation of the target fuel injection amount without hindering the other control operations and calculations.

Consequently, the number of calculations for determining the target injection amount can be increased without hindering the other control operations so that stabilization of the engine speed control can be realized. In addition, the number of other calculations can be increased, thus strikingly improving the stabilization of the control in this way as well.

I claim:

1. An electronically controlled fuel injection apparatus having a fuel injection pump for supplying fuel to an internal combustion engine, an actuator for controlling the operating position of a fuel regulating member for the fuel injection pump, means for producing a condition signal indicating the operating condition of the internal combustion engine, computing means for calculating target data relating to a target amount of fuel injection in response to the condition signal, and means for driving said actuator so as to obtain said target amount of fuel injection in response to the result of the calculation from said computing means, in which said computing means comprises first calculating means for performing two dimensional map calculation in response to the condition signal so as to obtain plural sets of data pairs, one member of each pair being indicative of the operating position of said fuel regulating member and the other member thereof being indicative of the corresponding engine speed;

means for generating speed data relating to the speed of the internal combustion engine; and second calculating means responsive to the speed data for carrying out an interpolation calculation once every predetermined degree of rotation of said internal combustion engine, the interpolation calculation being carried out on the basis of the plural sets of data pairs obtained from said first calculating means in order to obtain data relating to the target amount of fuel injection at the engine speed at each instant.

2. An apparatus as claimed in claim 1 wherein said first calculating means has map data indicating the relationship between the value of said condition signal and the speed of said internal combustion engine where the position of said fuel regulating member is taken as a parameter and the data pairs are obtained by a map calculation in response to the condition signal.

3. An apparatus as claimed in claim 1 wherein said condition signal is a signal indicative of the amount of operation of an accelerator pedal used for operating said internal combustion engine.

4. An apparatus as claimed in claim 2 wherein said condition signal is a signal indicative of the amount of operation of an accelerator pedal used for operating said internal combustion engine.

5. An apparatus as claimed in claim 3 wherein said first calculating means has a plurality of map calculating means each of which has map data indicating the relationship between the amount of operation of said accelerator pedal and the speed of said internal combustion engine for a predetermined position of said fuel regulating member which is different from the positions predetermined for the other map calculating means, and a plurality of sets of said data pairs are produced from said map calculating means in response to said condition signal.

6. An apparatus as claimed in claim 1, further comprising:

discriminating means for discriminating whether or not the target data is within a predetermined range; and means responsive to the output of said discriminating means for limiting the value of said target data within said predetermined range.

7. An apparatus as claimed in claim 1 wherein said computing means is arranged by the use of a microcomputer.

* * * * *